US010902781B2

(12) United States Patent
Xiao et al.

(10) Patent No.: US 10,902,781 B2
(45) Date of Patent: Jan. 26, 2021

(54) PIXEL CIRCUIT, DRIVING METHOD, ORGANIC LIGHT EMITTING DISPLAY PANEL, AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Yunsheng Xiao, Beijing (CN); Tingliang Liu, Beijing (CN); Hongwei Ma, Beijing (CN)

(73) Assignees: Chengdu BOE Optoelectronics Technology Co., Ltd., Chengdu (CN); BOE Technology Group Co., Ltd., Beiiing (CN)

( * ) Notice: Subject to any disclaimer, the term of this patent is extended or adjusted under 35 U.S.C. 154(b) by 0 days.

(21) Appl. No.: 16/414,044

(22) Filed: May 16, 2019

(65) Prior Publication Data

US 2020/0027402 A1 Jan. 23, 2020

(30) Foreign Application Priority Data

Jul. 23, 2018 (CN) ..... 2018 1 0811074

(51) Int. Cl.
*G09G 3/3233* (2016.01)
*G09G 3/3258* (2016.01)

(52) U.S. Cl.
CPC ... *G09G 3/3258* (2013.01); *G09G 2300/0426* (2013.01); *G09G 2320/0626* (2013.01)

(58) Field of Classification Search
CPC .. G09G 3/3258; G09G 3/3233; G09G 3/3266; G09G 3/3291; G09G 2320/0233;
(Continued)

(56) References Cited

U.S. PATENT DOCUMENTS

2004/0070557 A1* 4/2004 Asano ..... G09G 3/3233 345/76
2004/0080474 A1* 4/2004 Kimura ..... H01L 27/3265 345/82
(Continued)

FOREIGN PATENT DOCUMENTS

CN 1716370 A 1/2006
CN 1912978 A 2/2007
(Continued)

OTHER PUBLICATIONS

First Office Action for CN Appl. No. 201810811074.1, dated Jul. 29, 2019.

*Primary Examiner* — Olga V Merkoulova
(74) *Attorney, Agent, or Firm* — The Webb Law Firm

(57) ABSTRACT

The present disclosure relates to a pixel circuit, a driving method, an organic light emitting display panel, and a display device. The pixel circuit comprises: a threshold compensation sub-circuit, a capacitor sub-circuit, a light emitting control sub-circuit, a data writing sub-circuit, a driving sub-circuit, and a light emitting sub-circuit; the threshold compensation sub-circuit transmitting a reference signal provided by a data signal terminal to a first node, and transmitting an initialization signal provided by an initialization signal terminal to the light emitting control sub-circuit, connecting the light emitting control sub-circuit, the driving sub-circuit and a second node to store a threshold voltage of the driving sub-circuit through the capacitor sub-circuit under the control of a reset signal terminal; the light emitting control sub-circuit connecting the driving sub-circuit and the light emitting sub-circuit based on a light emitting control signal terminal to cause the light emitting sub-circuit to emit light.

18 Claims, 17 Drawing Sheets

(58) Field of Classification Search
CPC ..... G09G 2300/0819; G09G 2310/08; G09G 3/3275
See application file for complete search history.

(56) References Cited

U.S. PATENT DOCUMENTS

| | | | | |
|---|---|---|---|---|
| 2007/0085847 | A1* | 4/2007 | Shishido | G09G 3/3225 345/204 |
| 2010/0033461 | A1* | 2/2010 | Hasegawa | H04N 13/398 345/211 |
| 2010/0033462 | A1* | 2/2010 | Hasegawa | H04N 13/398 345/211 |
| 2011/0095967 | A1* | 4/2011 | Choi | G09G 3/3233 345/76 |
| 2011/0199357 | A1* | 8/2011 | Chung | G09G 3/3233 345/211 |
| 2011/0227885 | A1* | 9/2011 | Chung | G09G 3/3241 345/204 |
| 2011/0227956 | A1* | 9/2011 | Park | G09G 3/3233 345/690 |
| 2015/0097763 | A1* | 4/2015 | Park | G09G 3/3233 345/76 |
| 2016/0247449 | A1* | 8/2016 | Yin | G09G 3/3233 |

FOREIGN PATENT DOCUMENTS

| | | | |
|---|---|---|---|
| CN | 103839520 | A | 6/2014 |
| CN | 105336296 | A | 2/2016 |
| CN | 205282057 | U | 6/2016 |
| CN | 106531076 | A | 3/2017 |

* cited by examiner

PIXEL CIRCUIT, DRIVING METHOD, ORGANIC LIGHT EMITTING DISPLAY PANEL, AND DISPLAY DEVICE

CROSS-REFERENCE TO RELATED APPLICATIONS

The present application claims priority to application for Chinese Application No. 201810811074.1, filed on Jul. 23, 2018, the disclosure of which is hereby incorporated by reference in its entirety.

TECHNICAL FIELD

The present disclosure relates to a pixel circuit, a driving method, an organic light emitting display panel, and a display device.

BACKGROUND

At present, the active matrix organic light emitting diode (AMOLED) flexible screen technology, as a next generation display method to replace the liquid crystal display (LCD) panel, is becoming more and more popular, due to its flexible, high contrast and low power consumption characteristics.

Currently, there is still a demand for improved OLED panels.

SUMMARY

Embodiments of the present disclosure provide a pixel circuit, a driving method, an organic light emitting display panel, and a display device.

In an aspect of the present disclosure, there is provided a pixel circuit, comprising: a threshold compensation sub-circuit, a capacitor sub-circuit, a light emitting control sub-circuit, a data writing sub-circuit, a driving sub-circuit, and a light emitting sub-circuit; wherein:

the capacitor sub-circuit has a first terminal connected to a first reference signal terminal, a second terminal connected to a first node, and a third terminal connected to a second node;

the threshold compensation sub-circuit has a first terminal connected to a reset signal terminal, a second terminal connected to a data signal terminal, a third terminal connected to the first node, a fourth terminal connected to a first terminal of the light emitting control sub-circuit and a first terminal of the driving sub-circuit respectively, a fifth terminal connected to the second node, a sixth terminal connected to an initialization signal terminal, and a seventh terminal connected to a first terminal of the light emitting sub-circuit and a second terminal of the light emitting control sub-circuit respectively; a second terminal of the light emitting sub-circuit is connected to a second reference signal terminal; the threshold compensation sub-circuit is configured to transmit a reference signal provided by the data signal terminal to the first node, and transmit an initialization signal provided by the initialization signal terminal to the second terminal of the light emitting control sub-circuit, connect the first terminal of the light emitting control sub-circuit and the first terminal of the driving sub-circuit to the second node respectively to store a threshold voltage of the driving sub-circuit through the capacitor sub-circuit under the control of the reset signal terminal;

the data writing sub-circuit has a first terminal connected to a scan signal terminal, a second terminal connected to the data signal terminal, and a third terminal connected to the first node; the data writing sub-circuit is configured to transmit a data signal provided by the data signal terminal to the first node under the control of the scan signal terminal, and store a voltage of the data signal through the capacitor sub-circuit;

a third terminal of the light emitting control sub-circuit is connected to a light emitting control signal terminal; a second terminal of the driving sub-circuit is connected to the second node, and a third terminal of the driving sub-circuit is connected to the first reference signal terminal; the light emitting control sub-circuit is configured to connect the first terminal of the driving sub-circuit and the first terminal of the light emitting sub-circuit under the control of the light emitting control signal terminal to cause the light emitting sub-circuit to emit light.

In one example, in the above pixel circuit provided by an embodiment of the present disclosure, the threshold compensation sub-circuit comprises: a first switching transistor, a second switching transistor, and a third switching transistor; and wherein:

a gate electrode of the first switching transistor is connected to the reset signal terminal, a source electrode of the first switching transistor is connected to the data signal terminal, and a drain electrode of the first switching transistor is connected to the first node;

a gate electrode of the second switching transistor is connected to the reset signal terminal, a source electrode of the second switching transistor is connected to the first terminal of the light emitting control sub-circuit and the first terminal of the driving sub-circuit respectively, and a drain electrode of the second switching transistor is connected to the second node;

a gate electrode of the third switching transistor is connected to the reset signal terminal, a source electrode of the third switching transistor is connected to the initialization signal terminal, and a drain electrode of the third switching transistor is connected to the first terminal of the light emitting sub-circuit and the second terminal of the light emitting control sub-circuit.

In one example, in the above pixel circuit provided by an embodiment of the present disclosure, the capacitor sub-circuit comprises: a first capacitor and a second capacitor; and wherein:

a first terminal of the first capacitor is connected to the first reference signal terminal, and a second terminal of the first capacitor is connected to the first node;

a first terminal of the second capacitor is connected to the first node, and a second terminal of the second capacitor is connected to the second node.

In one example, in the above pixel circuit provided by an embodiment of the present disclosure, the light emitting control sub-circuit comprises: a fourth switching transistor; and wherein:

a gate electrode of the fourth switching transistor is connected to the light emitting control signal terminal, a source electrode of the fourth switching transistor is connected to the fourth terminal of the threshold compensation sub-circuit and the first terminal of the driving sub-circuit respectively, and a drain electrode of the fourth switching transistor is connected to the seventh terminal of the threshold compensation sub-circuit and the first terminal of the light emitting sub-circuit respectively.

In one example, in the above pixel circuit provided by an embodiment of the present disclosure, the data writing sub-circuit comprises: a fifth switching transistor; and wherein:

a gate electrode of the fifth switching transistor is connected to the scan signal terminal, a source electrode of the fifth switching transistor is connected to the data signal terminal, and a drain electrode of the fifth switching transistor is connected to the first node.

In one example, in the above pixel circuit provided by an embodiment of the present disclosure, the driving sub-circuit comprises: a driving transistor; and wherein:

a gate electrode of the driving transistor is connected to the second node, a source electrode of the driving transistor is connected to the first reference signal terminal, and a drain electrode of the driving transistor is connected to the fourth terminal of the threshold compensation sub-circuit and the first terminal of the light emitting control sub-circuit.

In one example, in the above pixel circuit provided by an embodiment of the present disclosure, all the transistors in the pixel circuit are P-type transistors or N-type transistors.

In another aspect of the present disclosure, an embodiment of the present disclosure further provides an organic light emitting display panel, comprising any of the above pixel circuits provided by the embodiments of the present disclosure.

In yet another aspect of the present disclosure, an embodiment of the present disclosure further provides a display device comprising the above organic light emitting display panel provided by an embodiment of the present disclosure.

In still another aspect of the present disclosure, an embodiment of the present disclosure further provides a driving method of any one of the above pixel circuits provided by the embodiment of the present disclosure, comprising: an initialization stage, a threshold writing stage, a data writing stage, and a light emitting stage; wherein:

in the initialization stage, the threshold compensation sub-circuit transmits a reference signal provided by the data signal terminal to the first node, and transmits an initialization signal provided by the initialization signal terminal to the second node;

in the threshold writing stage, the capacitor sub-circuit stores a threshold voltage of the driving sub-circuit;

in the data writing stage, the data writing sub-circuit transmits a data signal provided by the data signal terminal to the first node, and the capacitor sub-circuit stores a voltage of the data signal;

in the light emitting stage, the light emitting control sub-circuit connects the first terminal of the driving transistor to the first terminal of the light emitting sub-circuit, such that the driving transistor drives the light emitting sub-circuit to emit light.

DETAILED DESCRIPTION

Figure 1:
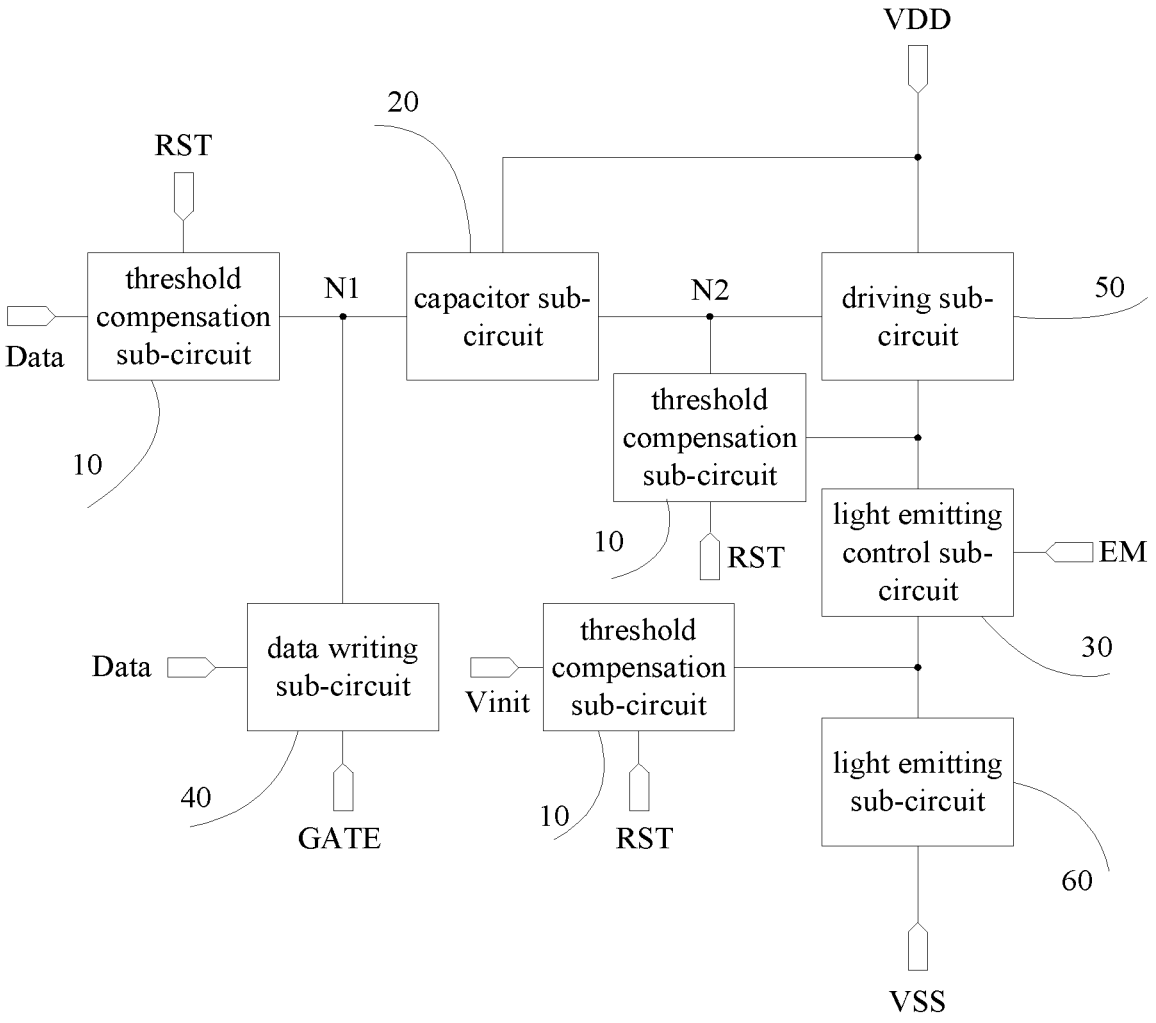
FIG. 1 is a schematic structural diagram of a pixel circuit according to an embodiment of the present disclosure.

In order to make objectives, technical schemes and advantages of the present disclosure more clear, the present disclosure will be further described in detail with reference to the accompanying drawings. Obviously, merely some embodiment of this disclosure, rather than all embodiments thereof, is given herein. All other embodiments obtained by those of ordinary skill in the art based on the embodiments of the present disclosure without creative efforts shall fall within the protection scope of the present disclosure.

The size and shape of each component in the drawings do not reflect the true scale thereof, and are only for a purpose of schematically illustrating the contents of the present invention.

Pixels in OLED panels are driven to emit light by a current generated by driving thin film transistors (DTFTs) in a saturated state. However, the current OLED panel manufacturing process is difficult to ensure the uniformity of the threshold voltage of the DTFTs, and the threshold voltage of the DTFTs may drift to different degrees during the use of OLED panels, so that a problem of uneven brightness of various pixels occurs in OLED panels.

In addition, with the development of display technology, OLED display devices for wearable devices with a relatively larger length-width ratio are increasingly popular. However, in an OLED display device having a larger length-width ratio of a wearable device, the power supply (VDD) voltage is more affected by the IR-Drop, which causes a problem of uneven overall brightness of the OLED display device.

A pixel circuit according to an embodiment of the present disclosure, as shown in FIG. 1, comprises: a threshold compensation sub-circuit 10, a capacitor sub-circuit 20, a light emitting control sub-circuit 30, a data writing sub-circuit 40, a driving sub-circuit 50, and a light emitting sub-circuit 60;

The capacitor sub-circuit 20 has a first terminal connected to a first reference signal terminal VDD, a second terminal connected to a first node N1, and a third terminal connected to a second node N2.

The threshold compensation sub-circuit 10 has a first terminal connected to a reset signal terminal RST, a second terminal connected to a data signal terminal Data, a third terminal connected to the first node N1, a fourth terminal respectively connected with a first terminal of the light emitting control sub-circuit 30 and a first terminal of the driving sub-circuit 50, a fifth terminal connected to the second node N2, a sixth terminal connected to an initialization signal terminal Vinit, and a seventh terminal respectively connected with a first terminal of the light emitting sub-circuit 60 and a second terminal of the light emitting control sub-circuit 30; a second terminal of the light emitting sub-circuit 60 is connected to a second reference signal terminal VSS; the threshold compensation sub-circuit is configured to transmit a reference signal provided by a data signal terminal Data to the first node N1, transmit an initialization signal provided by the initialization signal terminal Vinit to the second terminal of the light emitting control sub-circuit 30, connect the first terminal of the light emitting control sub-circuit and the first terminal of the driving sub-circuit to the second node N2 respectively, and store a threshold voltage of the driving sub-circuit 50 through the capacitor sub-circuit 20 under the control of a reset signal terminal RST.

The data writing sub-circuit 40 has a first terminal connected to a scan signal terminal GATE, a second terminal connected to the data signal terminal Data, and a third terminal connected to the first node N1; the data writing sub-circuit 40 is configured to transmit a data signal provided by the data signal terminal Data to the first node N1, and store a voltage of the data signal through the capacitor sub-circuit 20 under the control of the scan signal terminal GATE.

A third terminal of the light emitting control sub-circuit 30 is connected to a light emitting control signal terminal EM; a second terminal of the driving sub-circuit 50 is connected to the second node N2, and a third terminal of the driving sub-circuit 50 is connected to the first reference signal terminal VDD; the light emitting control sub-circuit 30 is configured to connect a first terminal of the driving sub-circuit 50 to a first terminal of the light emitting sub-circuit 60 under the control of the light emitting control signal terminal EM, so that the driving sub-circuit 50 drives the light emitting sub-circuit 60 to emit light under the control of the second node N2.

The pixel circuit provided in an embodiment of the present disclosure comprises: a threshold compensation sub-circuit, a capacitor sub-circuit, a light emitting control sub-circuit, a data writing sub-circuit, a driving sub-circuit, and a light emitting sub-circuit. The threshold compensation sub-circuit can transmit a reference signal provided by a data signal terminal to a first node, transmit an initialization signal provided by an initialization signal terminal to a second terminal of the light emitting control sub-circuit, connect a first terminal of the light emitting control sub-circuit and a first terminal of the driving sub-circuit to a second node respectively, and store a threshold voltage of the driving sub-circuit through the capacitor sub-circuit under the control of a reset signal terminal; the data writing sub-circuit can transmit a data signal provided by the data signal terminal to the first node, and store a voltage of the data signal through the capacitor sub-circuit under the control of a scan signal terminal. The light emitting control sub-circuit can connect a first terminal of the driving sub-circuit to a first terminal of the light emitting sub-circuit under the control of the light emitting control signal terminal, so that the driving sub-circuit drives the light emitting sub-circuit to emit light under the control of the second node. Through the cooperation of the above five sub-circuits, the threshold voltage of the driving sub-circuit can be compensated, so that the driving current is not affected by the threshold voltage of the driving sub-circuit, and the problem that the luminance of the various pixels is uneven due to non-uniformity of the threshold voltage is eliminated. Moreover, through the cooperation of the above five sub-circuits, the power supply voltage can be compensated so that the driving current is not affected by the power supply voltage, and the problem of uneven display brightness due to IR-Drop of the power supply voltage is eliminated.

Figure 2:
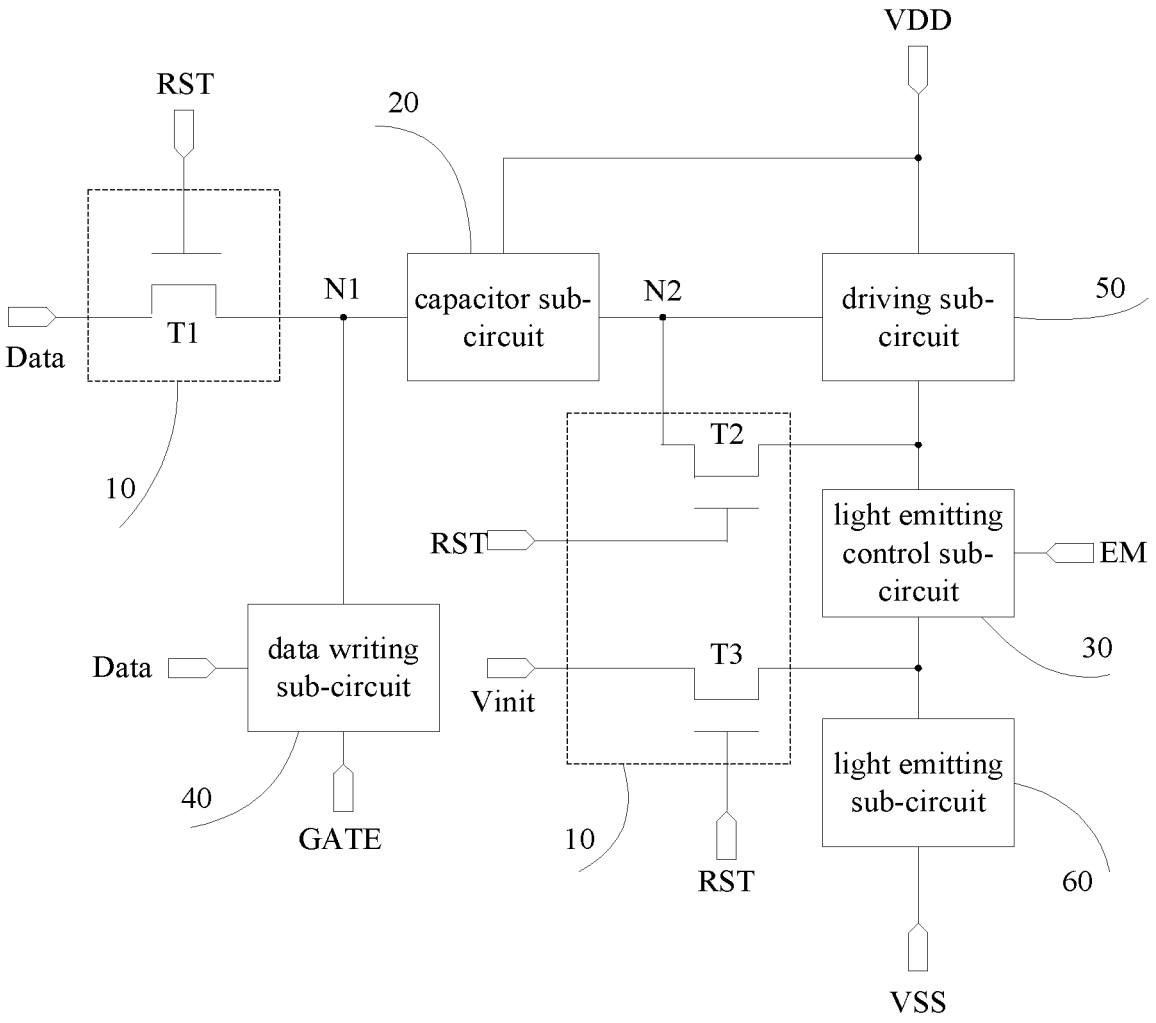
FIG. 2 is a circuit structural diagram of the pixel circuit according to an embodiment of the present disclosure.

In one example, in the above pixel circuit provided by the embodiment of the present disclosure, as shown in FIG. 2, the threshold compensation sub-circuit 10 may comprise, for example, a first switching transistor T1, a second switching transistor T2, and a third switching transistor T3.

The gate electrode of the first switching transistor T1 is connected to the reset signal terminal RST, the source electrode of T1 is connected to the data signal terminal Data, and the drain electrode of T1 is connected to the first node N1.

The gate electrode of the second switching transistor T2 is connected to the reset signal terminal RST, the source electrode of T2 is connected to the first terminal of the light emitting control sub-circuit 30 and the first terminal of the driving sub-circuit 50, respectively, and the drain electrode of T2 is connected to the second node N2.

The gate electrode of the third switching transistor T3 is connected to the reset signal terminal RST, the source electrode of T3 is connected to the initialization signal terminal Vinit, and the drain electrode of T3 is connected to the first terminal of the light emitting sub-circuit 60 and the second terminal of the light emitting control sub-circuit 30, respectively.

In the above pixel circuit provided by the embodiment of the present disclosure, the first switching transistor T1 transmits the data signal provided by the data line signal terminal Data to the first node N1, and stores the threshold voltage of the driving sub-circuit 50 through the capacitor sub-circuit 20 under the control of the reset signal terminal RST. The second switching transistor T2 connects the first node of the light emitting control sub-circuit 30 and the first terminal of the driving sub-circuit 50 to the second node N2 respectively under the control of the reset signal terminal RST. The third switching transistor T3 transmits the initialization signal provided by the initialization signal terminal Vinit to the second terminal of the light emitting control sub-circuit 30 under the control of the reset signal terminal RST.

The first switching transistor T1, the second switching transistor T2, and the third switching transistor T3 may be N-type transistors or P-type transistors, which are not limited herein; in a case where the first switching transistor T1, the second switching transistor T2, and the third switching transistor T3 are N-type transistors, these transistors are turned on when the reset signal terminal RST is at a high potential, and are turned off when the reset signal terminal RST is at a low potential; in a case where first switching transistor T1, the second switching transistor T2, and the third switching transistor T3 are P-type transistors, these transistors are turned on when the reset signal terminal RST is at a low potential, and are turned off when the reset signal terminal RST is at a high potential.

Figure 3:
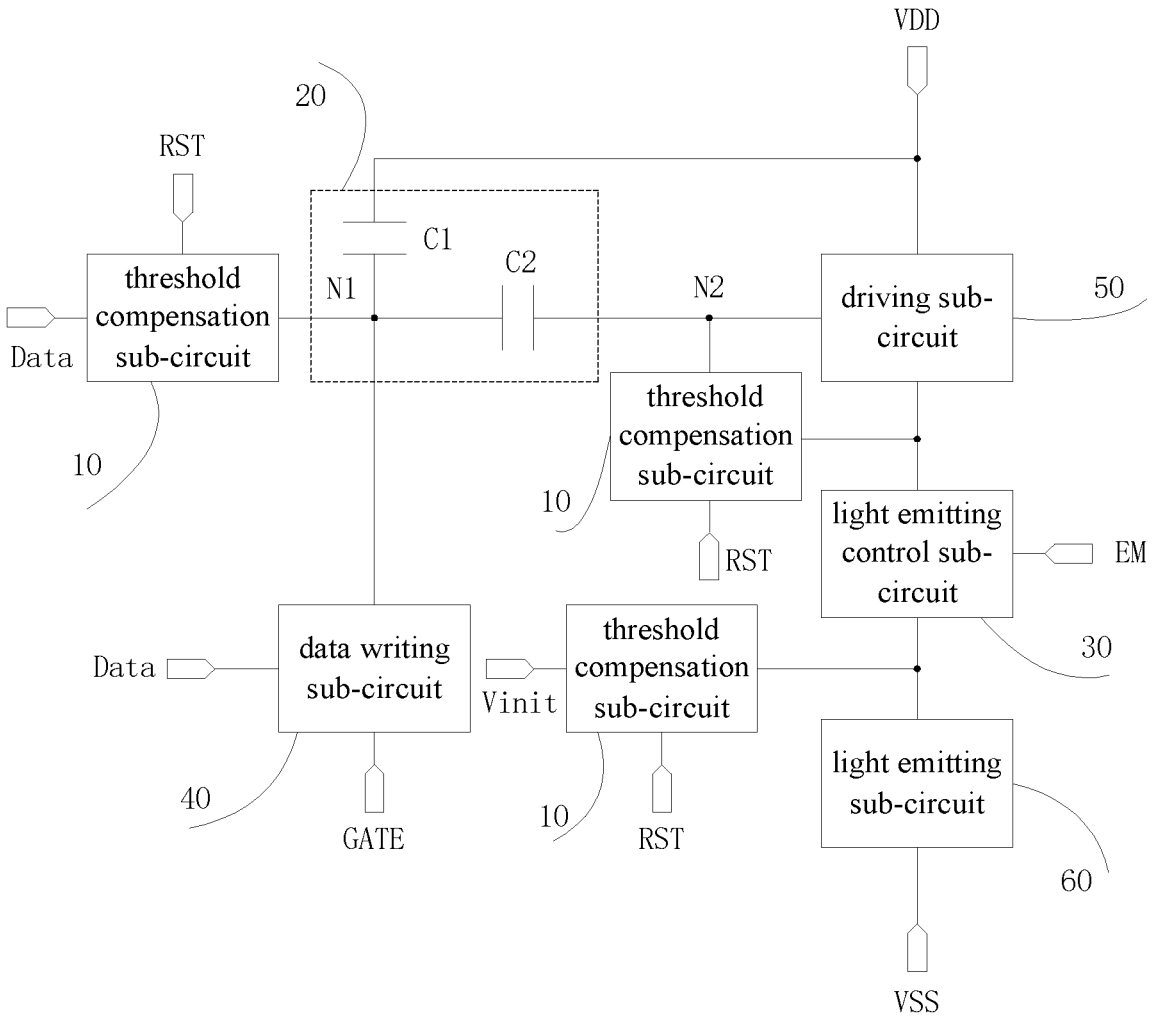
FIG. 3 is a circuit structural diagram of the pixel circuit according to an embodiment of the present disclosure.

In one example, in the above pixel circuit provided by the embodiment of the present disclosure, as shown in FIG. 3, the capacitor sub-circuit 20 may comprise, for example, a first capacitor C1 and a second capacitor C2.

A first terminal of the first capacitor C1 is connected to the first reference signal terminal VDD, and a second terminal of C1 is connected to the first node N1.

A first terminal of the second capacitor C2 is connected to the first node N1, and a second terminal of C2 is connected to the second node N2.

In the above pixel circuit provided by the embodiment of the present disclosure, the first capacitor C1 is configured to store the voltage of the first node N1, and the second capacitor is configured to store the voltage of the second node N2.

Figure 4:
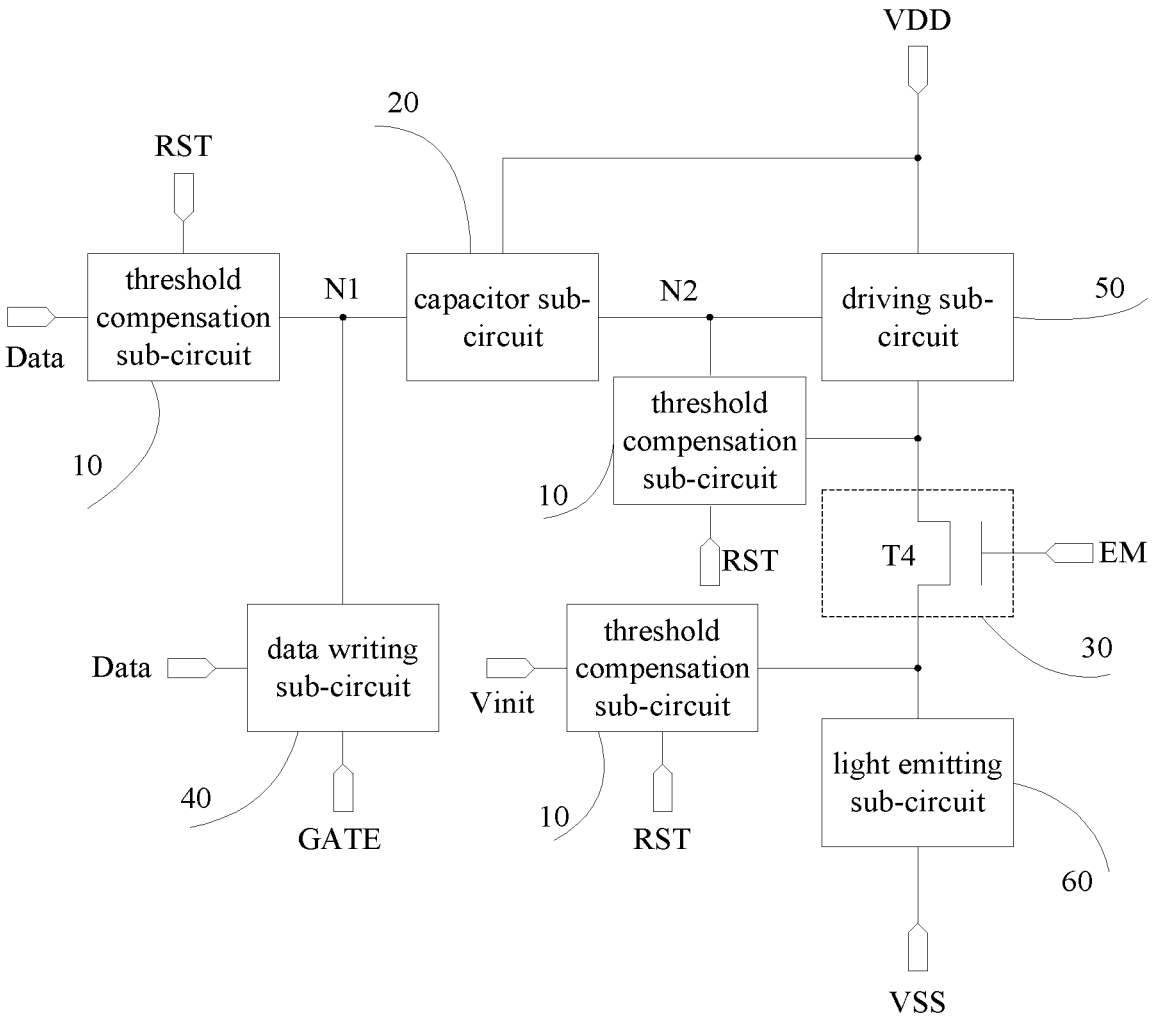
FIG. 4 is a circuit structural diagram of the pixel circuit according to an embodiment of the present disclosure.

In one example, in the above pixel circuit provided by the embodiment of the present disclosure, as shown in FIG. 4, the light emitting control sub-circuit 30 may comprise, for example, a fourth switching transistor T4.

A gate electrode of the fourth switching transistor T4 is connected to the light emitting control signal terminal EM, a source electrode of T4 is connected to the fourth terminal of the threshold compensation sub-circuit 10 and the first terminal of the driving sub-circuit 50 respectively, and a drain electrode of T4 is connected to the seventh terminal of the threshold compensation sub-circuit 10 and the first terminal of the light emitting sub-circuit 60 respectively.

In the above pixel circuit provided by the embodiment of the present disclosure, the fourth switching transistor T4 connects the first terminal of the driving sub-circuit 50 to the first terminal of the light emitting sub-circuit 60 under the control of the light emitting control signal terminal EM, so that the driving sub-circuit 50 drives the light emitting sub-circuit 60 to emit light under the control of the second node N2.

The fourth switching transistor T4 may be an N-type transistor or a P-type transistor, which is not limited herein; in a case where the fourth switching transistor T4 is an N-type transistor, it is turned on when the light emitting control signal terminal EM is at a high potential, and is turned off when the light emitting control signal terminal EM is at a low potential; in a case where the fourth switching transistor T4 is a P-type transistor, it is turned on when the light emitting control signal terminal EM is at a low potential, and is turned off when the light emitting control signal terminal EM is at a high potential.

Figure 5:
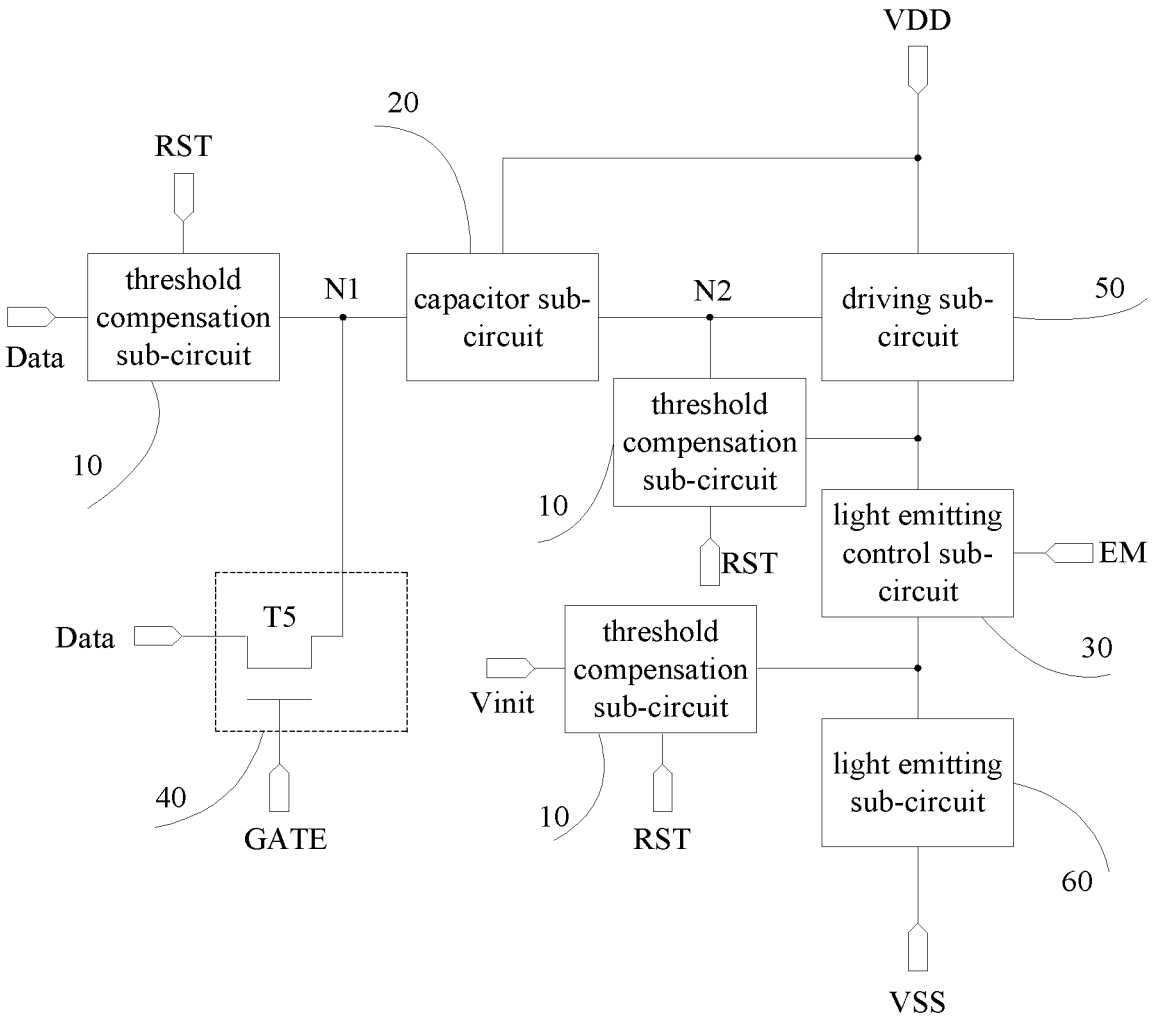
FIG. 5 is a circuit structural diagram of the pixel circuit according to an embodiment of the present disclosure.

In one example, in the above pixel circuit provided by the embodiment of the present disclosure, as shown in FIG. 5, the data writing sub-circuit 40 may comprise, for example, a fifth switching transistor T5.

The gate electrode of the fifth switching transistor T5 is connected to the scanning signal terminal GATE, the source electrode of T5 is connected to the data signal terminal Data, and the drain electrode of T5 is connected to the first node N1.

In the above pixel circuit provided by the embodiment of the present disclosure, the fifth switching transistor T5 transmits the data signal provided by the data line signal terminal Data to the first node N1 under the control of the scan signal terminal GATE.

The fifth switching transistor T5 may be an N-type transistor or a P-type transistor, which is not limited herein; in a case where the fifth switching transistor T5 is an N-type transistor, it is turned on when the scan signal terminal GATE is at a high potential, and is turned off when the scan signal terminal GATE is at a low potential; in a case where the fifth switching transistor T5 is a P-type transistor, it is turned on when the scan signal terminal GATE is at a low potential, and is turned off when the scan signal terminal GATE is at a high potential.

Figure 6:
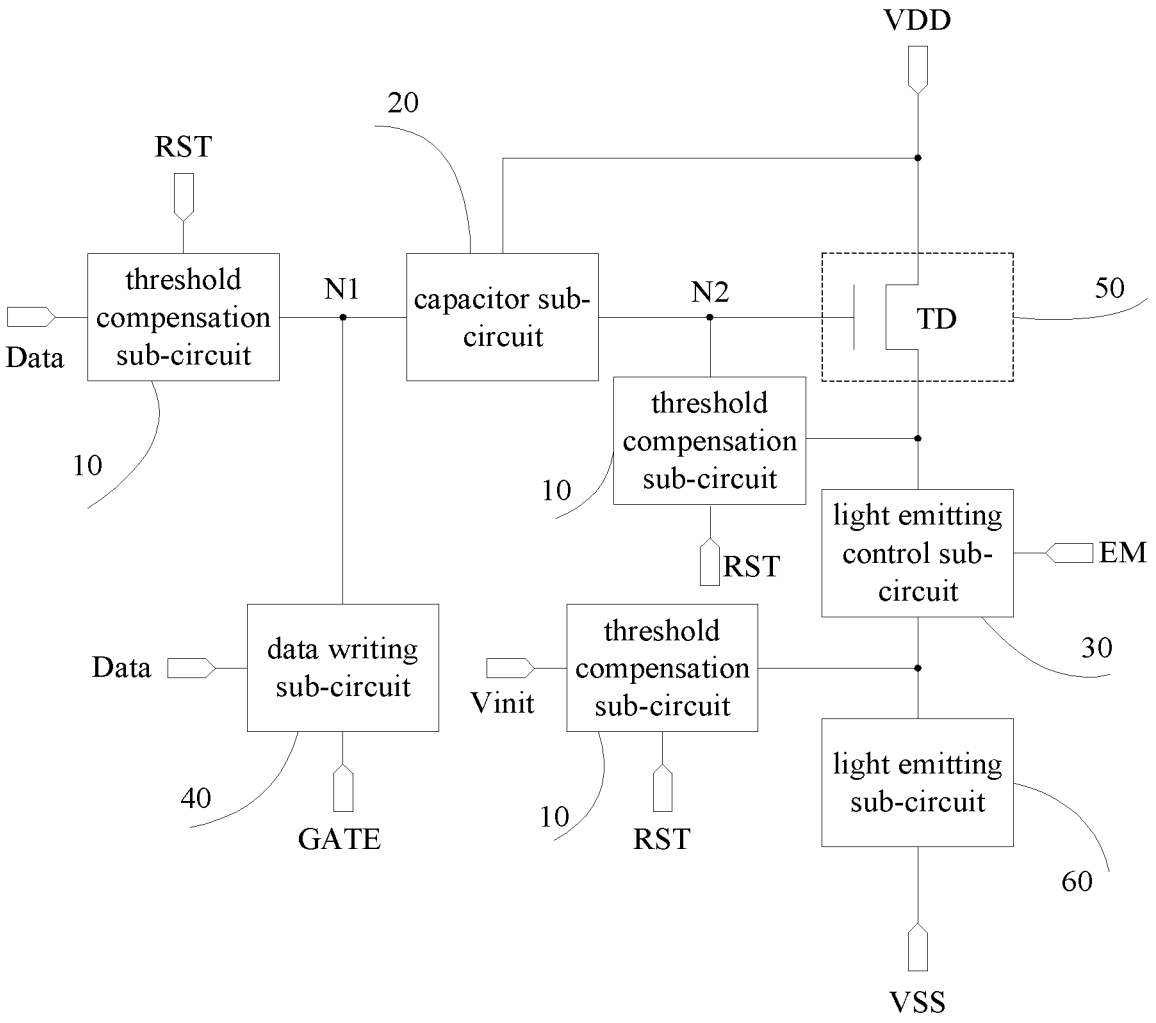
FIG. 6 is a circuit structural diagram of the pixel circuit according to an embodiment of the present disclosure.

In one example, in the above pixel circuit provided by the embodiment of the present disclosure, as shown in FIG. 6, the driving sub-circuit 50 may comprise, for example, a driving transistor TD.

A gate electrode of the driving transistor TD is connected to the second node N2, a source electrode of TD is connected to the first reference signal terminal VDD, and a drain electrode of TD is connected to the fourth terminal of the threshold compensation sub-circuit 10 and the first terminal of the light emitting control sub-circuit 30 respectively.

In the above pixel circuit provided by the embodiment of the present disclosure, the driving transistor TD drives the light emitting sub-circuit 60 to emit light under the control of the second node N2.

The driving transistor TD may be an N-type transistor or a P-type transistor, which is not limited herein; in a case where the driving transistor TD is an N-type transistor, it is turned on when the second node N2 is at a high potential, and is turned off when the second node N2 is at a low potential; in a case where the driving transistor TD is a P-type transistor, it is turned on when the second node N2 is at a low potential, and is turned off when the second node N2 is at a high potential.

Figure 7:
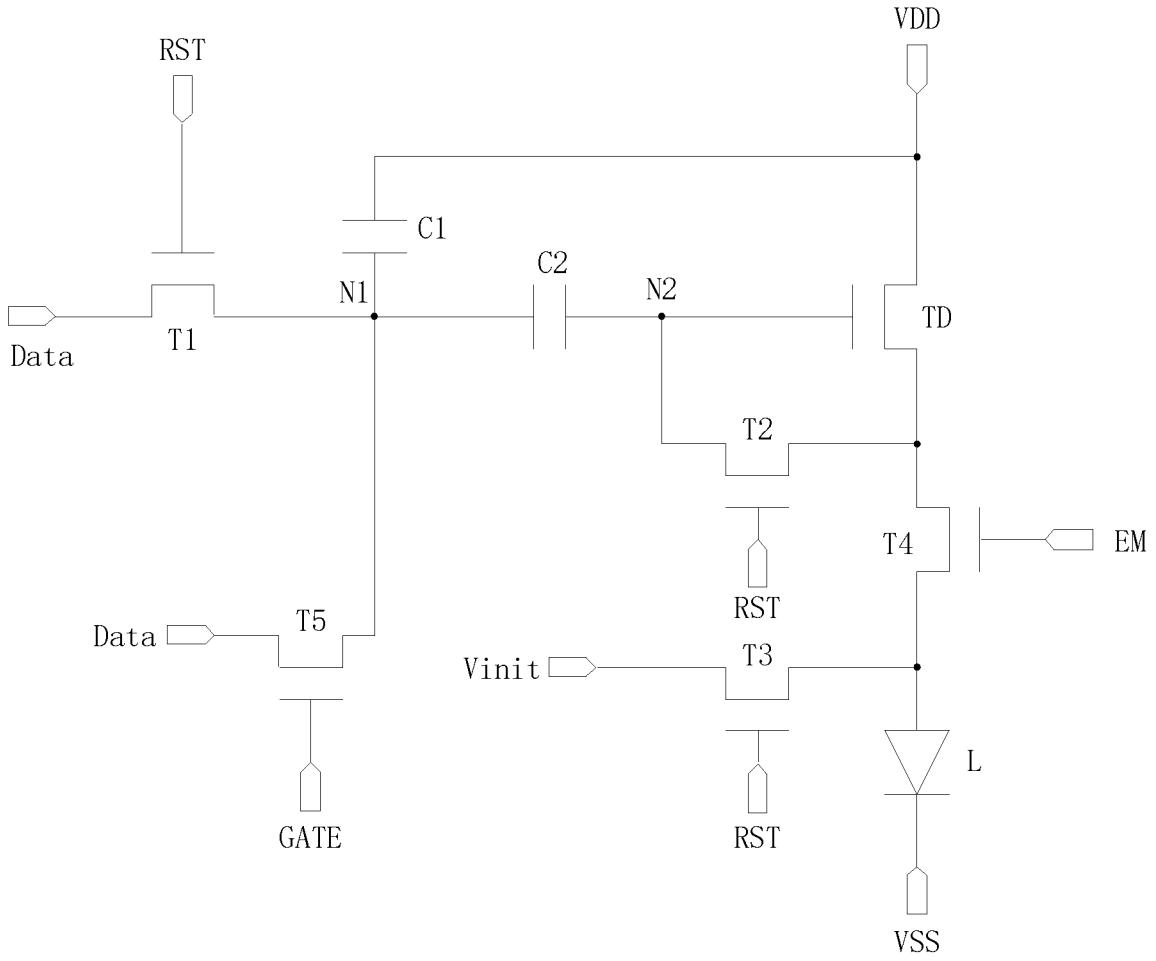
FIG. 7 is a specific circuit structural diagram of the pixel circuit according to an embodiment of the present disclosure.

In one example, in the above pixel circuit provided by the embodiment of the present disclosure, as shown in FIG. 7, the light emitting sub-circuit 60 is generally an organic light emitting diode L, which emits light under the action of a current when the driving transistor TD is in a saturated state. Moreover, the anode of the organic light emitting diode L is the first terminal of the organic light emitting diode L, and the cathode is the second terminal of the organic light emitting diode L.

The above only shows specific structures of the various sub-circuits in the pixel circuit provided by the embodiment of the present disclosure. In a specific implementation, the specific structures of the above various sub-circuit are not limited to the above structures provided by the embodiment of the present disclosure, and may also be other structures known to the those skilled in the art, which are not limited herein.

In one example, in the above pixel circuit provided by the embodiment of the present disclosure, all the transistors may be P-type transistors or N-type transistors to simplify the manufacturing process, which is not limited herein.

With the pixel circuit shown in FIG. 7 as an example, the operation of the pixel circuit provided by the embodiment of the present disclosure will be described below with reference to the timing diagram of circuit signals shown in FIG. 8. In the following description, "1" indicates a high potential, and "0" indicates a low potential. It should be noted that "1" and "0" are logic potentials, which are only used to explain the specific working process of the embodiment of the present disclosure better, and are not potentials applied to the gate electrodes of the respective switching transistors in the specific implementation.

In a specific implementation, in the above pixel circuit provided by the embodiment of the present disclosure, the voltage VDD of the first reference signal, the voltage VSS of the second reference signal, and the voltage Vinit of the initialization signal are all greater than the threshold voltage Vth of the driving transistor TD.

Figure 8:
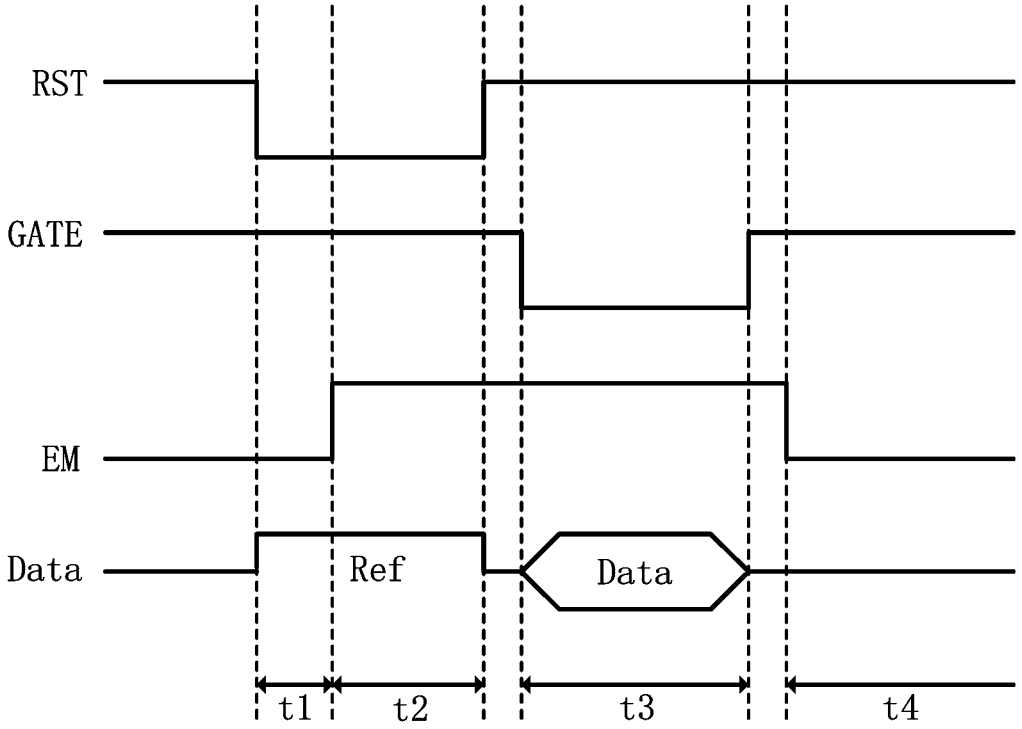
FIG. 8 is a signal timing diagram of the pixel circuit shown in FIG. 7.

As shown in FIG. 7, all the transistors are P-type transistors; a corresponding input timing diagram is shown in FIG. 8. Specifically, four stages of t1, t2, t3, and t4 in the input timing diagram shown in FIG. 8 are selected.

Figure 9A:
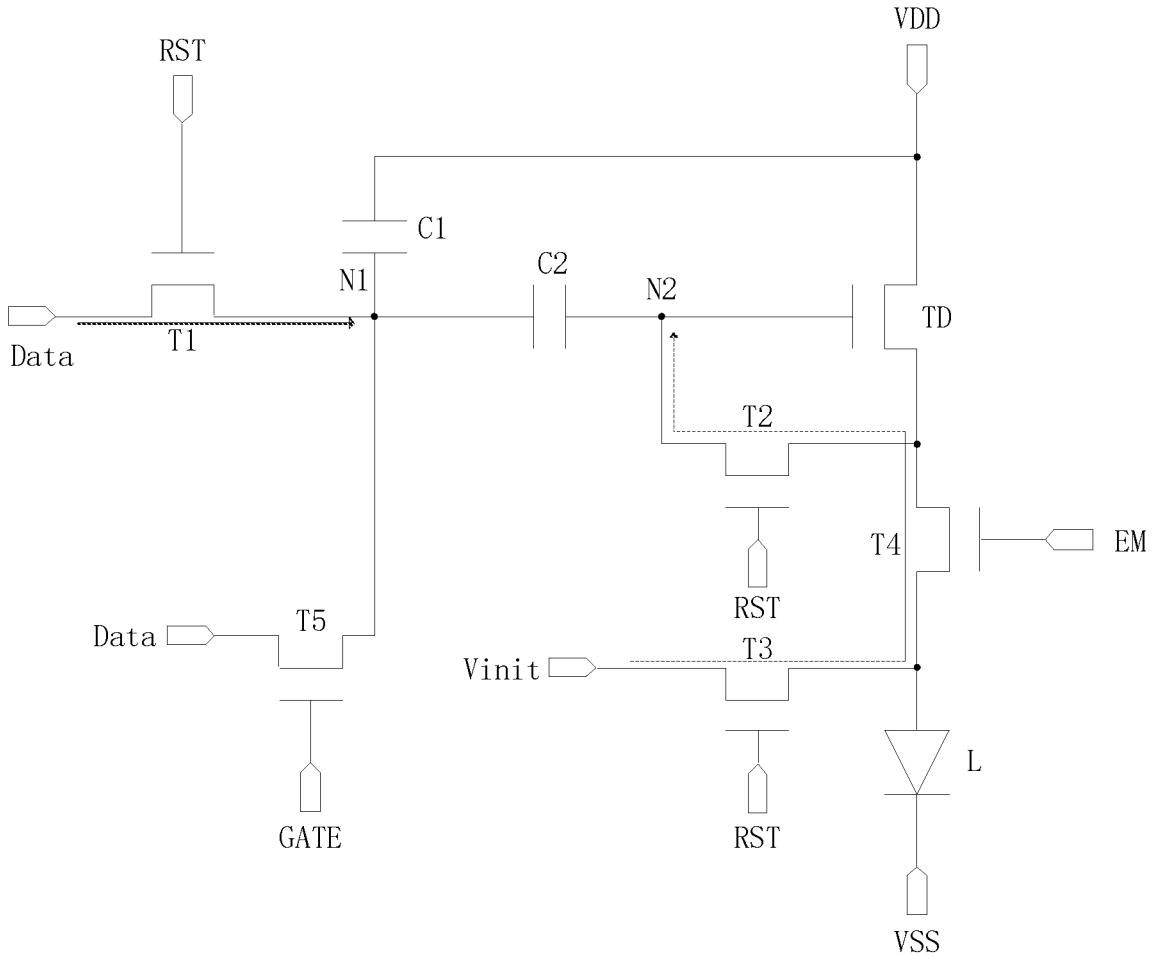
FIG. 9*a* is an operating state diagram of the pixel circuit at stage t1 according to the embodiment of the present disclosure.
Figure 9B:
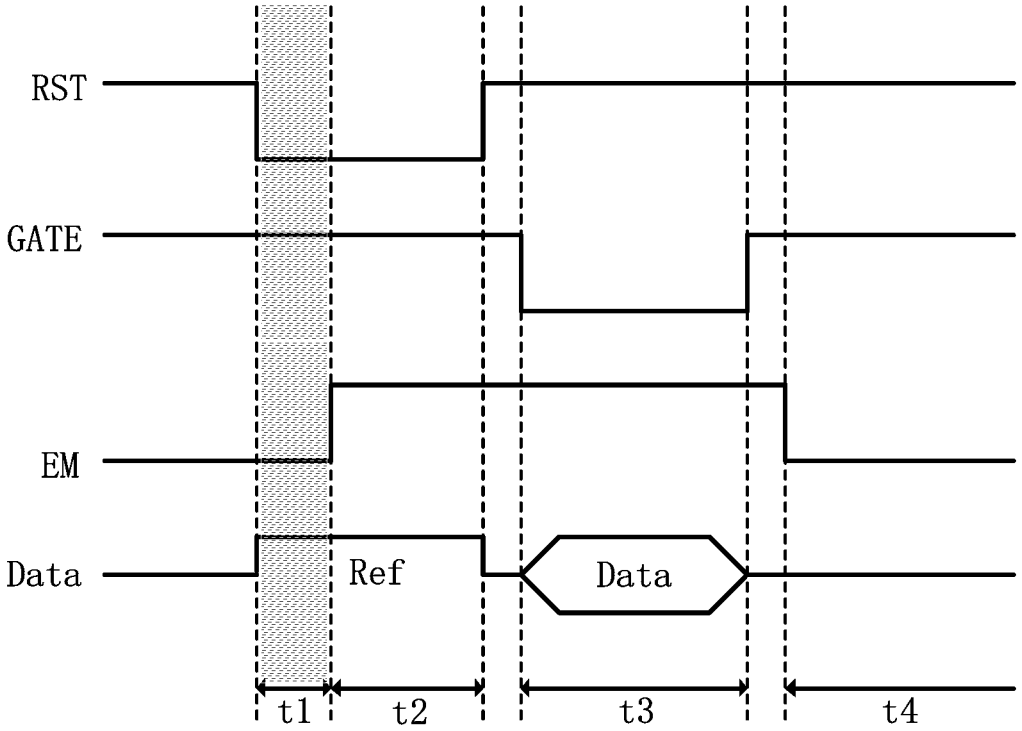
FIG. 9*b* is a signal timing diagram of the pixel circuit shown in FIG. 9*a;*

In the t1 stage, the operating state of the pixel circuit is, as shown in FIGS. 9*a* and 9*b*, RST=0, EM=0, GATE=1.

Therefore, the first switching transistor T1, the second switching transistor T2, the third switching transistor T3, and the fourth switching transistor T4 are turned on, and the fifth switching transistor T5 and the driving transistor TD are turned off. In this stage, the data signal terminal Data outputs the voltage Ref of the reference signal. Since the first switching transistor T1 is turned on, the voltage Ref of the reference signal is output to the first node N1 via the first switching transistor T1 and stored in the first capacitor C1. At the same time, since the second switching transistor T2, the third switching transistor T3, and the fourth switching transistor T4 are turned on, the voltage of the initialization signal terminal Vinit is output to the second node N2 and stored in the second capacitor C2. At this time, the voltage at the first node N1 is: Ref, and the voltage at the second node N2 is: Vg=Vinit.

Figure 10A:
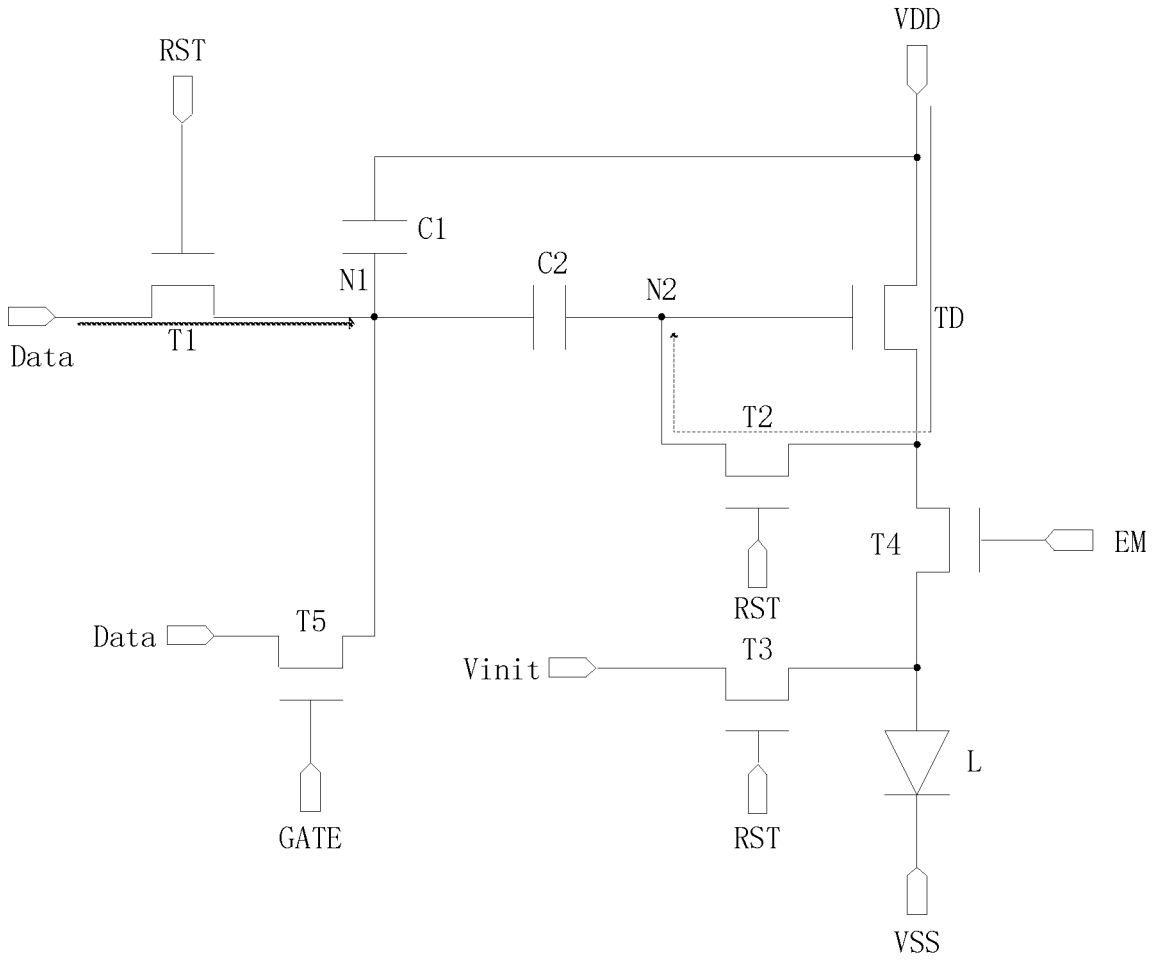
FIG. 10*a* is an operating state diagram of the pixel circuit at stage t2 according to the embodiment of the present disclosure.
Figure 10B:
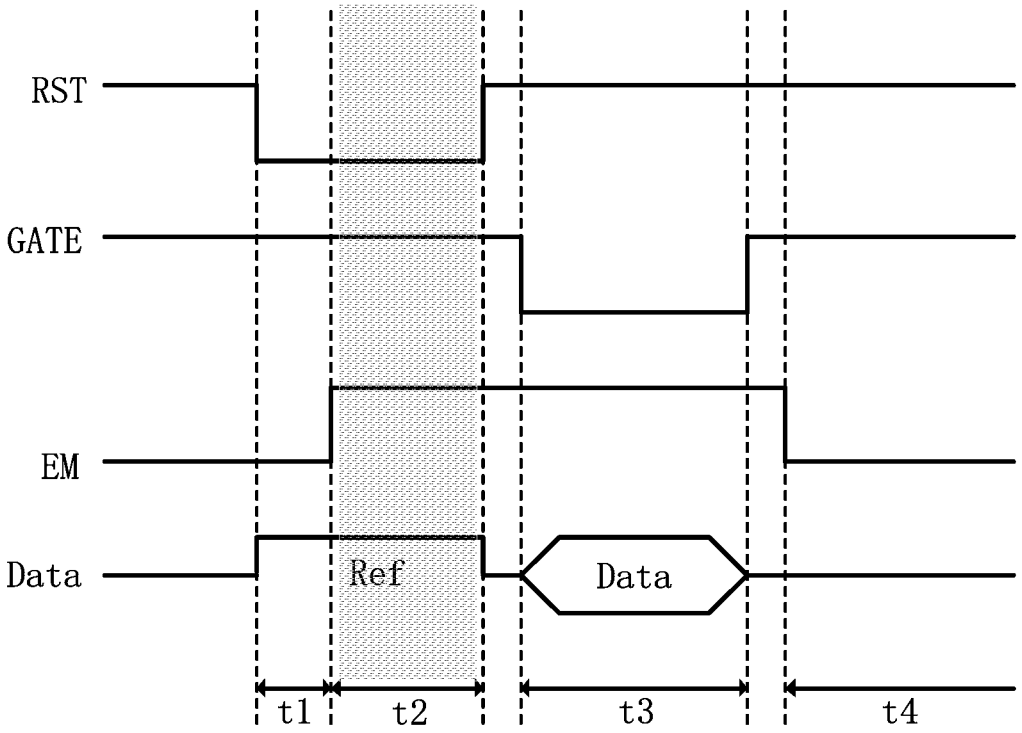
FIG. 10*b* is a signal timing diagram of the pixel circuit shown in FIG. 10*a;*

In the t2 stage, the operating state of the pixel circuit is, as shown in FIGS. 10*a* and 10*b*, RST=0, EM=1, GATE=1. Therefore, the first switching transistor T1 remains in the on state, and in this stage, the data signal terminal Data still remains the voltage Ref of the reference signal, so that Ref is output to the first node N1 via the first switching transistor T1 and stored in the first capacitor C1. At the same time, since the second capacitor C2 still stores the Vinit voltage input at the t1 stage, the voltage difference between the second node N2 and the source electrode of the driving transistor TD is: Vinit-VDD. At this time, the Vgs voltage of the driving transistor TD is: Vinit−VDD<Vth, the driving transistor TD is turned on, and the voltage VDD of the first reference signal charges the second capacitor C2 via the driving transistor TD. When the voltage at the second node N2 rises to VDD+Vth, voltage Vgs at this time is VDD+Vth−VDD=Vth and the driving transistor TD is turned off. At last, the voltage at the second node N2: Vg=VDD+Vth, where Vth is the threshold voltage of the driving transistor TD.

Figure 11A:
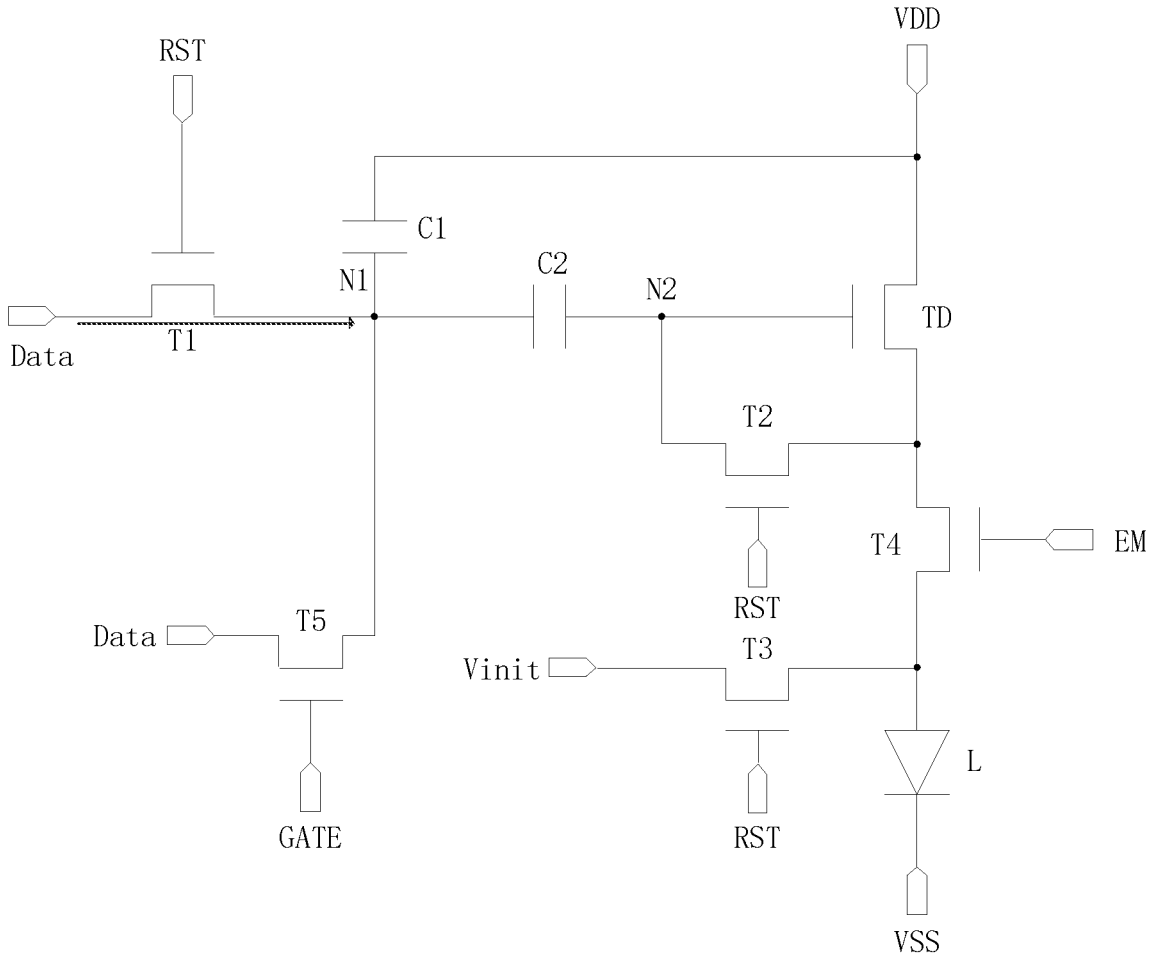
FIG. 11*a* is an operating state diagram of the pixel circuit at stage t3 according to the embodiment of the present disclosure.
Figure 11B:
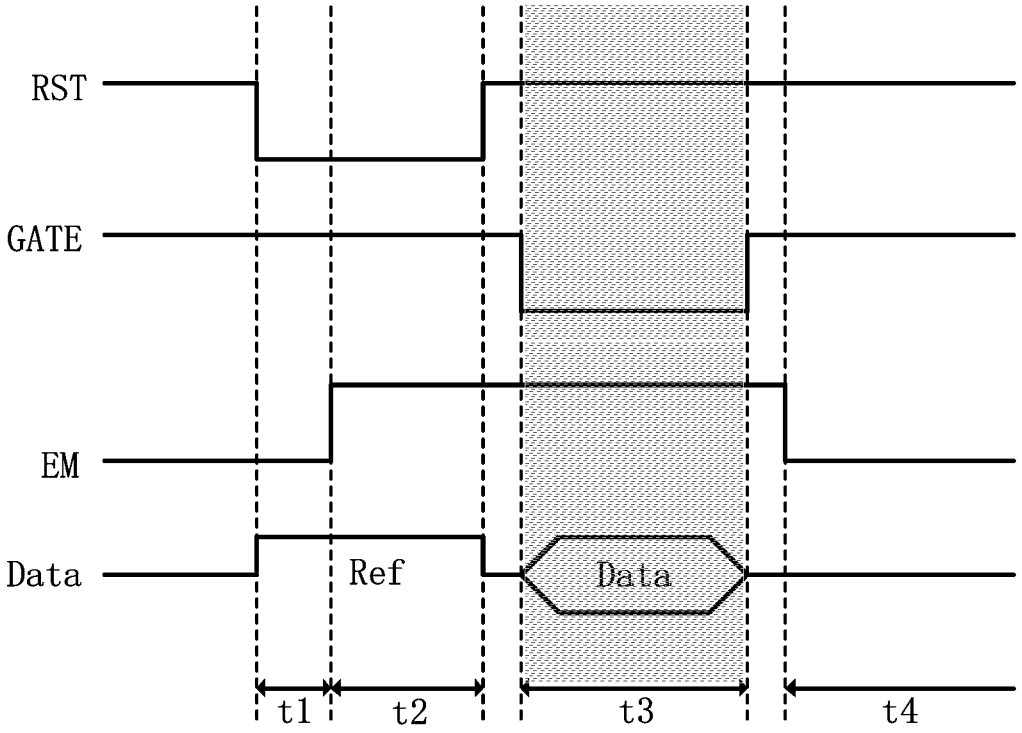
FIG. 11*b* is a signal timing diagram of the pixel circuit shown in FIG. 11*a;*

In the t3 stage, the operating state of the pixel circuit is, as shown in FIGS. 11*a* and 11*b*, RST=1, EM=1, GATE=0. At this time, the fifth switching transistor T5 is turned on, and the remaining transistors are turned off, and at this stage, the voltage signal outputted by the data signal terminal Data is changed from the voltage Ref of the reference signal to the voltage Vdata of the data signal, so that the voltage Vdata of the data signal is output to the first node N1 through the fifth switching transistor T5. The voltage at the first node N1 becomes: Vdata; since the power of the second capacitor C2 is conserved, the voltage of the second node N2 jumps to: Vg=Vdata−Ref+VDD+Vth.

Figure 12A:
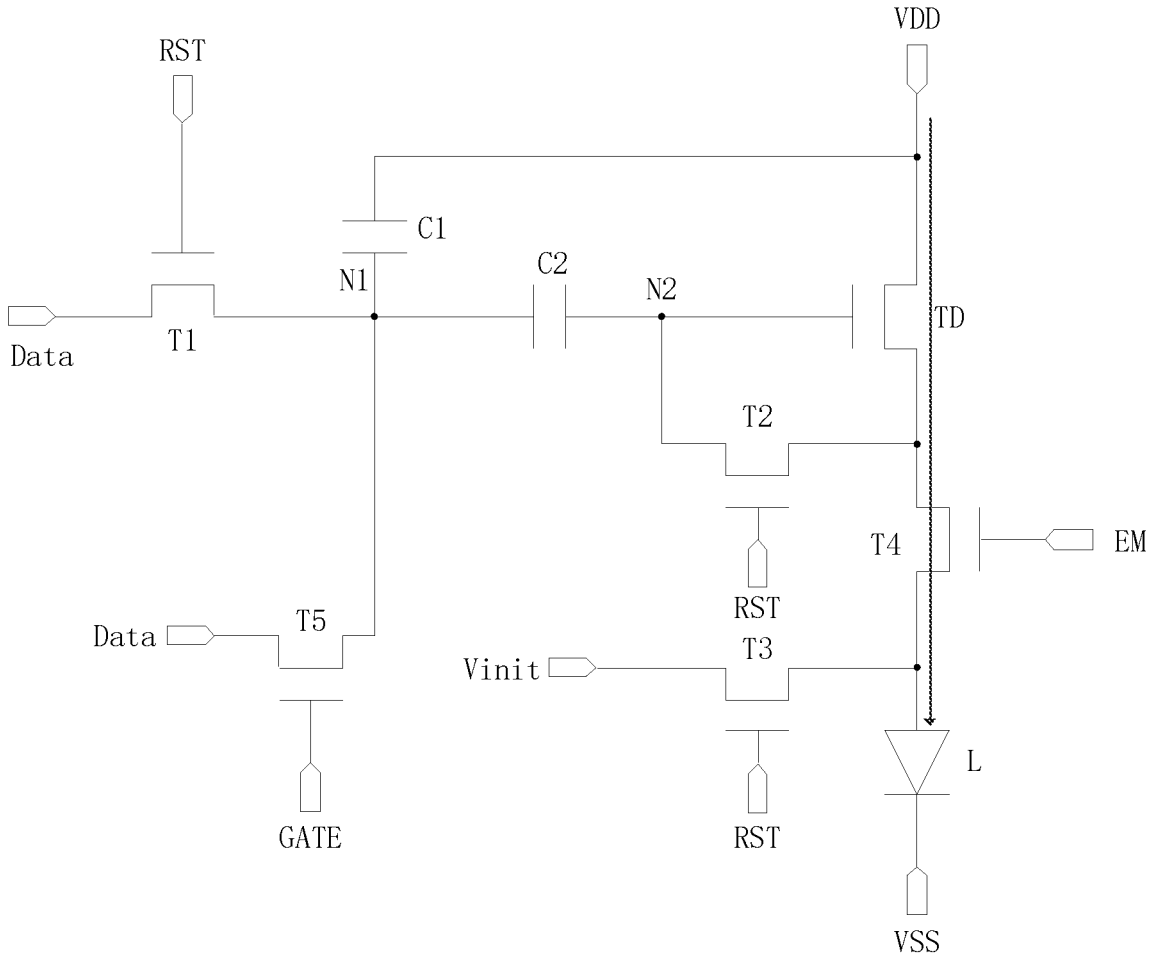
FIG. 12*a* is an operating state diagram of the pixel circuit at stage t4 according to the embodiment of the present disclosure.
Figure 12B:
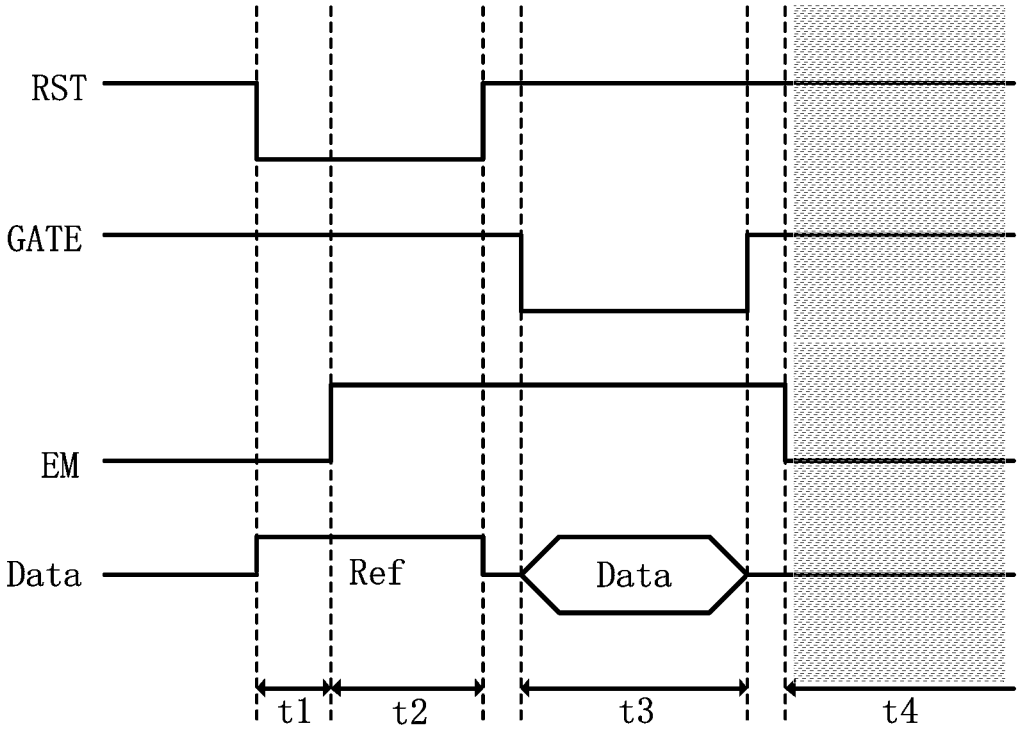
FIG. 12*b* is a signal timing diagram of the pixel circuit shown in FIG. 12*a;*

In the t4 stage, the operating state of the pixel circuit is, as shown in FIGS. 12*a* and 12*b*, RST=1, EM=0, GATE=1. Therefore, the fourth switching transistor T4 is turned on, and the remaining switching transistors are turned off. In addition, since the two capacitors have no discharge path, the second node N2 still retains the voltage of the t3 stage: Vdata−Ref+VDD+Vth, and the gate-source voltage difference of the driving transistor TD is: Vgs=(Vdata−Ref); the driving transistor TD is turned on, and the driving current output from the driving transistor TD flows to the anode of the organic light emitting diode L via the fourth switching transistor T4. The organic light emitting diode L emits light under the driving current to display according to a grayscale level.

In the t4 stage, the gate voltage of the driving transistor TD is: Vdata−Ref+VDD+Vth; according to the saturation current formula: I_OLED=½K(Vgs−Vth)^2=½ K(Vg−VDD−Vth)^2=½K(Vdata−Ref+VDD+Vth−VDD−Vth)^2=½K(Vdata−Ref)^2, where K is a process constant.

It can be seen from the above formula that the operating current I_OLED of the organic light emitting diode L is not affected by the threshold voltage Vth of the driving transistor TD, and is only related to the voltage of the data signal Data and the voltage Ref of the reference signal, thus the problem that the threshold voltage of the driving transistor TD drifts caused by the manufacturing process and long-time operation is solved, and the normal operation of the organic light emitting diode can be ensured. In addition, in general, the uniformity of illumination of the display device is also affected by the IR-Drop of the first reference signal terminal VDD. However, in the pixel circuit, it can be known from the formula of the light emitting control current that, when the driving transistor TD operates in the saturation region, the magnitude of its saturation current is independent of the magnitude of the first reference signal VDD. Therefore, the pixel circuit can solve the problem of uneven brightness due to the IR-Drop of the first reference signal terminal VDD.

Figure 13:
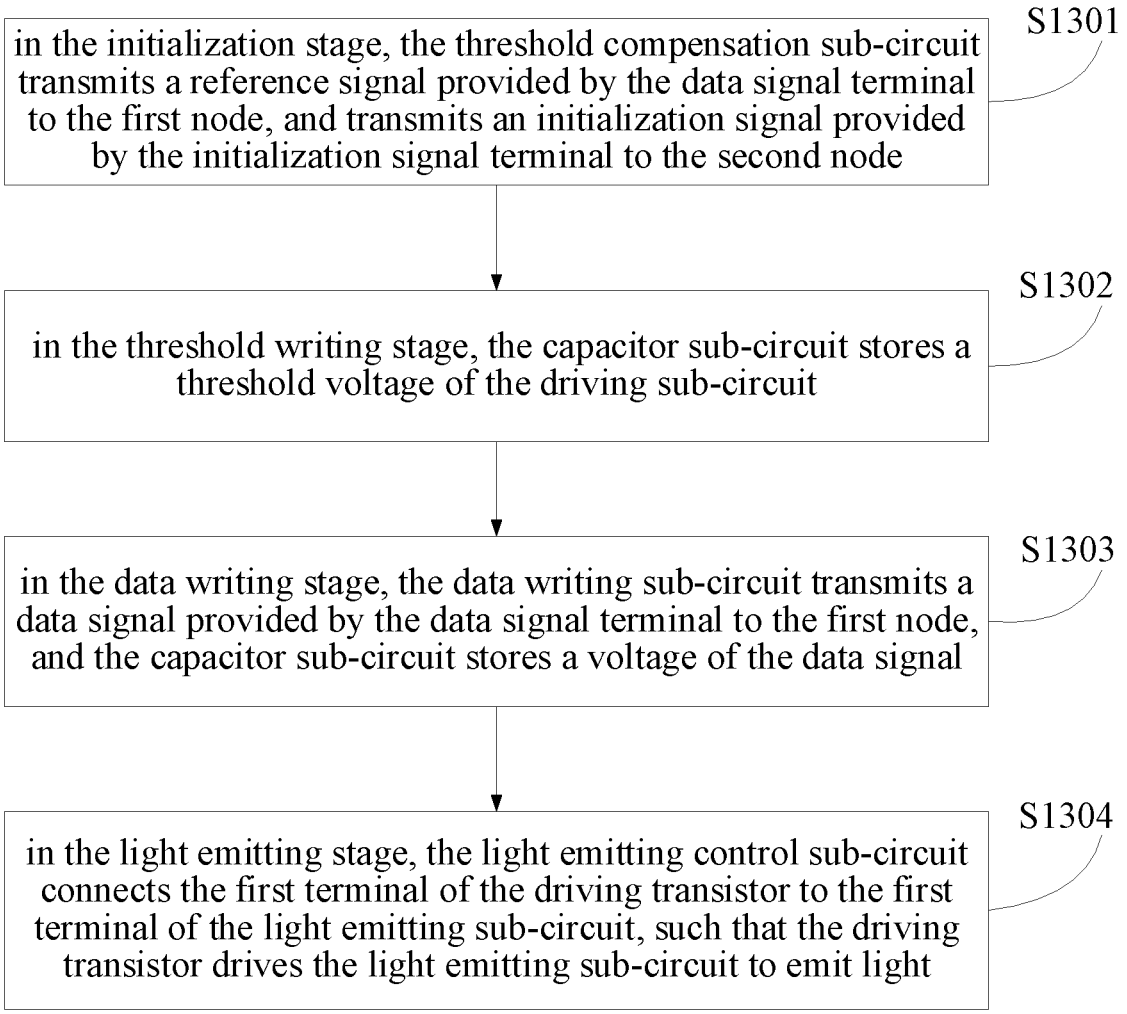
FIG. 13 is a flowchart of a driving method according to an embodiment of the present disclosure.

Based on the same inventive concept, an embodiment of the present disclosure further provides a driving method of the above pixel circuit according to an embodiment of the present disclosure. As shown in FIG. 13, the method comprises: an initialization stage, a threshold writing stage, a data writing stage, and a light emitting stage.

At S1301, in the initialization stage, the threshold compensation sub-circuit transmits a reference signal provided by the data signal terminal to the first node, and transmits an initialization signal provided by the initialization signal terminal to the second node;

At S1302, in the threshold writing stage, the capacitor sub-circuit stores a threshold voltage of the driving sub-circuit.

At S1303, in the data writing stage, the data writing sub-circuit transmits a data signal provided by the data signal terminal to the first node, and the capacitor sub-circuit stores a voltage of the data signal.

At S1304, in the light emitting stage, the light emitting control sub-circuit connects the first terminal of the driving transistor to the first terminal of the light emitting sub-circuit, such that the driving transistor drives the light emitting sub-circuit to emit light.

In the above driving method provided by the embodiment of the present disclosure, the function of compensating for the threshold voltage of the driving transistor and removing the influence of the IR-Drop of first reference signal terminal VDD can be realized by simple timing.

Based on the same inventive concept, an embodiment of the present disclosure further provides an organic light emitting display panel, including any of the above pixel circuits provided by the embodiments of the present disclosure. The principle of the solution of the organic light emitting display panel is similar to that of the pixel circuit described above. Therefore, reference can be made to the implementation of the pixel circuit described above for the implementation of the organic light emitting display panel, which will not be repeated herein.

Based on the same inventive concept, a display device is further provided in an embodiment of the present disclosure, which includes the organic light emitting display panel provided in the embodiment of the present disclosure. The display device may be a mobile phone, a tablet computer, a TV, a display, a notebook computer, a digital frame, a navigator or any other product or component having display function. As understood by the present disclosure, the display device has other indispensable components, which will not be described in detail herein, and should not be construed as limitation on the disclosure. For the implementation of the display device, reference may be made to the embodiment of the above pixel circuit, and its repeated description will be omitted herein.

The pixel circuit provided in an embodiment of the present disclosure comprises: a threshold compensation sub-circuit, a capacitor sub-circuit, a light emitting control sub-circuit, a data writing sub-circuit, a driving sub-circuit, and a light emitting sub-circuit; The threshold compensation sub-circuit can transmit a reference signal provided by a data signal terminal to a first node, transmit an initialization signal provided by an initialization signal terminal to a second terminal of the light emitting control sub-circuit, connect a first terminal of the light emitting control sub-circuit and a first terminal of the driving sub-circuit to a second node respectively, and store a threshold voltage of the driving sub-circuit through the capacitor sub-circuit under the control of a reset signal terminal; the data writing sub-circuit can transmit a data signal provided by the data signal terminal to the first node, and store a voltage of the data signal through the capacitor sub-circuit under the control of a scan signal terminal; the light emitting control sub-circuit can connect a first terminal of the driving sub-circuit to a first terminal of the light emitting sub-circuit under the control of the light emitting control signal terminal, so that the driving sub-circuit drives the light emitting sub-circuit to emit light under the control of the second node. Through the cooperation of the above five sub-circuits, the threshold voltage of the driving sub-circuit can be compensated, so that the driving current is not affected by the threshold voltage of the driving sub-circuit, and the problem that the luminance of the various pixels is uneven due to non-uniformity of the threshold voltage is eliminated. Moreover, through the cooperation of the above five sub-circuits, the power supply voltage can be compensated so that the driving current is not affected by the power supply voltage, and the problem of uneven display brightness due to IR-Drop of the power supply voltage is eliminated.

It will be apparent to those skilled in the art that various modifications and variations can be made to the embodiments of the present disclosure without departing from the spirit or scope of the present disclosure. In this case, if the modifications and variations made to the present disclosure fall within the scope of the claims of the present disclosure and equivalents thereof, the present disclosure is intended to comprise the modifications and variations.

What is claimed is:

1. A pixel circuit, including:

a threshold compensation sub-circuit, a capacitor sub-circuit, a light emitting control sub-circuit, a data writing sub-circuit, a driving sub-circuit, and a light emitting sub-circuit; wherein:

the capacitor sub-circuit has a first terminal connected to a first reference signal terminal, a second terminal connected to a first node, and a third terminal connected to a second node;

the threshold compensation sub-circuit has a first terminal connected to a reset signal terminal, a second terminal connected to a data signal terminal, a third terminal connected to the first node, a fourth terminal connected to a first terminal of the light emitting control sub-circuit and a first terminal of the driving sub-circuit respectively, a fifth terminal connected to the second node, a sixth terminal connected to an initialization signal terminal, and a seventh terminal connected to a first terminal of the light emitting sub-circuit and a second terminal of the light emitting control sub-circuit respectively; a second terminal of the light emitting sub-circuit is connected to a second reference signal terminal; the threshold compensation sub-circuit is configured to transmit a reference signal provided by the data signal terminal to the first node, and transmit an initialization signal provided by the initialization signal terminal to the second terminal of the light emitting control sub-circuit, connect the first terminal of the light emitting control sub-circuit and the first terminal of the driving sub-circuit to the second node respectively to store a threshold voltage of the driving sub-circuit through the capacitor sub-circuit under the control of the reset signal terminal;

the data writing sub-circuit has a first terminal connected to a scan signal terminal, a second terminal connected to the data signal terminal, and a third terminal connected to the first node; the data writing sub-circuit is configured to transmit a data signal provided by the data signal terminal to the first node, and store a voltage of the data signal through the capacitor sub-circuit under the control of the scan signal terminal; and a third terminal of the light emitting control sub-circuit is connected to a light emitting control signal terminal; a second terminal of the driving sub-circuit is connected to the second node, and a third terminal of the driving sub-circuit is connected to the first reference signal terminal; the light emitting control sub-circuit is configured to connect the first terminal of the driving sub-circuit and the first terminal of the light emitting sub-circuit under the control of the light emitting control signal terminal to cause the light emitting sub-circuit to emit light;

wherein the threshold compensation sub-circuit comprises: a first switching transistor, a second switching transistor, and a third switching transistor; and wherein:

a gate electrode of the first switching transistor is connected to the reset signal terminal, a source electrode of the first switching transistor is connected to the data signal terminal, and a drain electrode of the first switching transistor is connected to the first node;

a gate electrode of the second switching transistor is connected to the reset signal terminal, a source electrode of the second switching transistor is connected to the first terminal of the light emitting control sub-circuit and the first terminal of the driving sub-circuit respectively, and a drain electrode of the second switching transistor is connected to the second node; and a gate electrode of the third switching transistor is connected to the reset signal terminal, a source electrode of the third switching transistor is connected to the initialization signal terminal, and a drain electrode of the third switching transistor is connected to the first terminal of the light emitting sub-circuit and the second terminal of the light emitting control sub-circuit, wherein the data signal terminal is configured to output voltage of the reference signal in the first and second operation stages of the pixel circuit and the data signal in a third operation stage of the pixel circuit.

2. The pixel circuit according to claim 1, wherein the capacitor sub-circuit comprises: a first capacitor and a second capacitor; and wherein:

a first terminal of the first capacitor is connected to the first reference signal terminal, and a second terminal of the first capacitor is connected to the first node;

a first terminal of the second capacitor is connected to the first node, and a second terminal of the second capacitor is connected to the second node.

3. The pixel circuit according to claim 1, wherein the light emitting control sub-circuit comprises: a fourth switching transistor; and wherein:

a gate electrode of the fourth switching transistor is connected to the light emitting control signal terminal, a source electrode of the fourth switching transistor is connected to the fourth terminal of the threshold compensation sub-circuit and the first terminal of the driving sub-circuit respectively, and a drain electrode of the fourth switching transistor is connected to the seventh terminal of the threshold compensation sub-circuit and the first terminal of the light emitting sub-circuit respectively.

4. The pixel circuit according to claim 1, wherein the data writing sub-circuit comprises: a fifth switching transistor; and wherein:

a gate electrode of the fifth switching transistor is connected to the scan signal terminal, a source electrode of the fifth switching transistor is connected to the data signal terminal, and a drain electrode of the fifth switching transistor is connected to the first node.

5. The pixel circuit according to claim 1, wherein the driving sub-circuit comprises: a driving transistor; and wherein:

a gate electrode of the driving transistor is connected to the second node, a source electrode of the driving transistor is connected to the first reference signal terminal, and a drain electrode of the driving transistor is connected to the fourth terminal of the threshold compensation sub-circuit and the first terminal of the light emitting control sub-circuit respectively.

6. The pixel circuit according to claim 1, wherein all transistors in the pixel circuit are P-type transistors or N-type transistors.

7. An organic light emitting display panel comprising the pixel circuit of claim 1.

8. The organic light emitting display panel of claim 7, wherein the threshold compensation sub-circuit comprises: a first switching transistor, a second switching transistor, and a third switching transistor; and wherein:

a gate electrode of the first switching transistor is connected to the reset signal terminal, a source electrode of the first switching transistor is connected to the data signal terminal, and a drain electrode of the first switching transistor is connected to the first node;

a gate electrode of the second switching transistor is connected to the reset signal terminal, a source electrode of the second switching transistor is connected to the first terminal of the light emitting control sub-circuit and the first terminal of the driving sub-circuit respectively, and a drain electrode of the second switching transistor is connected to the second node;

a gate electrode of the third switching transistor is connected to the reset signal terminal, a source electrode of the third switching transistor is connected to the initialization signal terminal, and a drain electrode of the third switching transistor is connected to the first terminal of the light emitting sub-circuit and the second terminal of the light emitting control sub-circuit.

9. The organic light emitting display panel of claim 7, wherein the capacitor sub-circuit comprises: a first capacitor and a second capacitor; and wherein:

a first terminal of the first capacitor is connected to the first reference signal terminal, and a second terminal of the first capacitor is connected to the first node;

a first terminal of the second capacitor is connected to the first node, and a second terminal of the second capacitor is connected to the second node.

10. The organic light emitting display panel of claim 7, wherein the light emitting control sub-circuit comprises: a fourth switching transistor; and wherein:

a gate electrode of the fourth switching transistor is connected to the light emitting control signal terminal, a source electrode of the fourth switching transistor is connected to the fourth terminal of the threshold compensation sub-circuit and the first terminal of the driving sub-circuit respectively, and a drain electrode of the fourth switching transistor is connected to the seventh terminal of the threshold compensation sub-circuit and the first terminal of the light emitting sub-circuit respectively.

11. The organic light emitting display panel of claim 7, wherein the data writing sub-circuit comprises: a fifth switching transistor; and wherein:

a gate electrode of the fifth switching transistor is connected to the scan signal terminal, a source electrode of the fifth switching transistor is connected to the data signal terminal, and a drain electrode of the fifth switching transistor is connected to the first node.

12. The organic light emitting display panel of claim 7, wherein the driving sub-circuit comprises: a driving transistor; and wherein:

a gate electrode of the driving transistor is connected to the second node, a source electrode of the driving transistor is connected to the first reference signal terminal, and a drain electrode of the driving transistor is connected to the fourth terminal of the threshold compensation sub-circuit and the first terminal of the light emitting control sub-circuit.

13. A display device, comprising the organic light emitting display panel of claim 7.

14. A driving method of the pixel circuit of claim 1, comprising: an initialization stage, a threshold writing stage, a data writing stage, and a light emitting stage; and wherein:

in the initialization stage, the threshold compensation sub-circuit transmits a reference signal provided by the data signal terminal to the first node, and transmits an initialization signal provided by the initialization signal terminal to the second node;

in the threshold writing stage, the capacitor sub-circuit stores a threshold voltage of the driving sub-circuit;

in the data writing stage, the data writing sub-circuit transmits a data signal provided by the data signal terminal to the first node, and the capacitor sub-circuit stores a voltage of the data signal;

in the light emitting stage, the light emitting control sub-circuit connects the first terminal of the driving transistor to the first terminal of the light emitting sub-circuit, such that the driving transistor drives the light emitting sub-circuit to emit light, wherein the first, second, and third operation stages are the initialization stage, the threshold writing stage, and the data writing stage respectively.

15. The method according to claim 14, wherein the capacitor sub-circuit comprises: a first capacitor and a second capacitor; and wherein:

a first terminal of the first capacitor is connected to the first reference signal terminal, and a second terminal of the first capacitor is connected to the first node;

a first terminal of the second capacitor is connected to the first node, and a second terminal of the second capacitor is connected to the second node.

16. The method according to claim 14, wherein the light emitting control sub-circuit comprises: a fourth switching transistor; and wherein:

a gate electrode of the fourth switching transistor is connected to the light emitting control signal terminal, a source electrode of the fourth switching transistor is connected to the fourth terminal of the threshold compensation sub-circuit and the first terminal of the driving sub-circuit respectively, and a drain electrode of the fourth switching transistor is connected to the seventh terminal of the threshold compensation sub-circuit and the first terminal of the light emitting sub-circuit respectively.

17. The method according to claim 14, wherein the data writing sub-circuit comprises: a fifth switching transistor; and wherein:

a gate electrode of the fifth switching transistor is connected to the scan signal terminal, a source electrode of the fifth switching transistor is connected to the data signal terminal, and a drain electrode of the fifth switching transistor is connected to the first node.

18. The method according to claim 14, wherein the driving sub-circuit comprises: a driving transistor; and wherein:

a gate electrode of the driving transistor is connected to the second node, a source electrode of the driving transistor is connected to the first reference signal terminal, and a drain electrode of the driving transistor is connected to the fourth terminal of the threshold compensation sub-circuit and the first terminal of the light emitting control sub-circuit.

* * * * *